United States Patent [19]

Williams

[11] 4,151,975

[45] May 1, 1979

[54] PANEL JUNCTION ASSEMBLY

[76] Inventor: Chester I. Williams, 347 Greenbriar, SE., Grand Rapids, Mich. 49506

[21] Appl. No.: 845,080

[22] Filed: Oct. 25, 1977

[51] Int. Cl.[2] ..... E04G 11/06

[52] U.S. Cl. ..... 249/44; 249/42; 249/47; 249/191; 249/193

[58] Field of Search ..... 249/40, 42, 44, 45–47, 249/190, 191, 193, 196, 213, 216

[56] References Cited

U.S. PATENT DOCUMENTS

| | | | |
|---|---|---|---|
| 1,682,740 | 9/1928 | Colt | 249/46 |
| 2,631,352 | 3/1953 | Williams | 249/42 |
| 2,823,441 | 2/1958 | Williams | 249/190 |

FOREIGN PATENT DOCUMENTS

| | | | |
|---|---|---|---|
| 725134 | 3/1955 | United Kingdom | 249/40 |

*Primary Examiner*—Richard B. Lazarus
*Assistant Examiner*—John McQuade
*Attorney, Agent, or Firm*—Glenn B. Morse

[57] ABSTRACT

Wall form panels with flanges along adjacent edges are joined by a channel strip traversed at the base of the channel by tie systems securing opposite panel assemblies in spaced parallel relationship to receive concrete between them. Securing bolts or wedge pins traverse the adjacent flanges and the walls of the junction channel, and the tie systems are cross-pinned to the assembly to positively establish the spacing of the opposite panel assemblies. A series of tie system components is preferably sub-assembled to the channel so that this separately-connected group of parts can be handled as one unit as it is interposed between the edges of the form panels, and held in place by the panel-securing fasteners.

3 Claims, 6 Drawing Figures

PANEL JUNCTION ASSEMBLY

BACKGROUND OF THE INVENTION

It is common practice in the formation of concrete walls to erect a form system which includes parallel spaced panels interconnected by a tie system which traverses the space between the panels. Usually, the central members of the tie system remain embedded in the concrete. The primary advantage of such an arrangement is that the forces resulting from the deposition of the initially plastic concrete are balanced out between the opposite form panels, and thus require a minimum of bracing from the outside. Such bracing can be limited to maintaining the vertical orientation of the assembled form system.

The forces resulting from the placement of the plastic concrete are extremely high, as this material generates a liquid pressure of approximately one hundred sixty pounds per square foot per foot of depth, the latter corresponding to the height of the wall. The increased pressure at the lower extremeties of the form system result in a closer spacing of cross-tie components in this area, which are commonly a foot or so apart at the bottom of a wall of substantial height, increasing to perhaps three feet apart at the top. A contractor that is particularly active in this type of construction will normally be using metal form panels sufficiently short in lateral dimension to be handled conveniently by lifting equipment, and installed in edge-to-edge relationship to form a substantially continuous panel system having a coplanar forming surface. When parallel panel groups are installed in this manner, and the tie systems properly installed, concrete can be deposited between the panels according to standard procedures. One of the most effective cross-tie systems that have been developed for securing such panels has involved the use of threaded rods of high-tensile steel positioned in the central area between the paralled form panels, these being connected at opposite ends to bolts that traverse the panel system, and are secured to it to transfer the stresses involved. When the concrete has hardened sufficiently, the bolts are rotatably disconnected, and the form panels "stripped", leaving the central rods embedded in the concrete. Recesses formed by the inward projection of the bolts, which expose the ends of the threaded rods, can either be left exposed, or filled as may be desired.

This type of tie system has been rather difficult to incorporate in metal form panels, as a result of problems involved in properly engineering the points where the bolts traverse the relatively thin sheet metal of the forms. Stress transfer must accommodate the relatively heavy concentration at the ties, which receive the collected stresses distributed over the area of the panel. In addition to these structural problems, the erection and stripping procedures involving the installation and removal of large numbers of the bolts presents a problem in time and convenience. A significant feature in common in most standard form panels is the presence of a relatively heavy edge flange at the meeting edges of the panel units, which is commonly used to receive cross-fastenings securing the panels laterally together to prevent leakage of the concrete between them. The present invention utilizes this common feature in a structure which requires no further modification of standard form panels, and eliminates entirely the matter of providing special stress-concentration reinforcement at the point where the bolts for the tie system traverse the panel units.

SUMMARY OF THE INVENTION

A substantially U-shaped channel is interposed between the meeting edges of adjacent panel sections of a wall form system, and is traversed by fastenings interconnecting the standard edge flanges of the panels that define these adjacent edges. The base, or transverse portion, of the channel is provided with vertically-spaced apertures for receiving the bolts of a tie system, and the bolts are preferably cross-pinned to the channel independantly of the fastenings that traverse the panel flanges. Preferably, the channel projects inwardly (into the space between the planes of the form panels) to define a vertical groove in the concrete. This not only produces an interesting design feature, but conceals the usual recessess left by the inward projection of the ends of the bolts.

DESCRIPTION OF THE PREFERRED EMBODIMENTS

Figure 1:
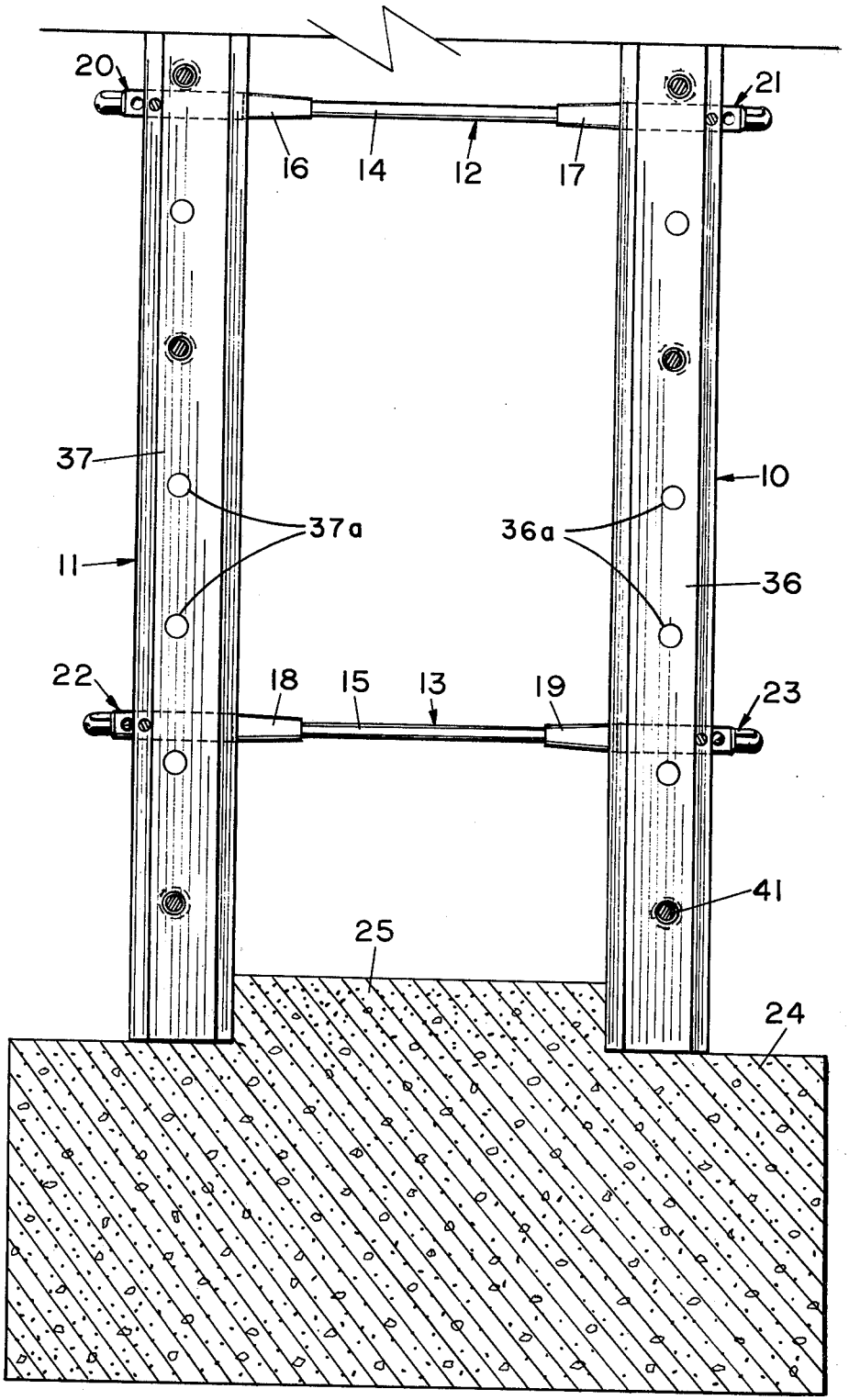
FIG. 1 is a fragmentary section on a vertical plane through an erected form system at the junction of adjacent form panels on opposite sides of a wall space, showing the junction channels in side elevation.

Referring to FIG. 1, the horizontally-spaced panel assemblies indicated generally at 10 and 11 are shown interconnected at positions in a vertical plane normal to the panel systems 10 and 11 by the tie assemblies indicated at 12 and 13. Each of these includes a rod as shown at 14 and 15 of high-tensile steel, which is threaded at its opposite ends to receive the internal threading in the tapered inner ends 16–19 of the bolts generally indicated at 20–23 traversing the form assemblies. Removal of the bolts, and the stripping of the forms, leaves a group of tapered recesses formed by the bolt ends 16–19, and leaves the rods 14 and 15 embedded in the set concrete. Preferably, the forms will be positioned initially by a footing shown at 24 of cast concrete, which will have a central elevated portion 25 for locating the entire form system with respect to the footing. The presence of the locating portion 25 permits the tie system to be tightened solidly against this member, and reduces the need for exterior placement bracing.

Figure 2:
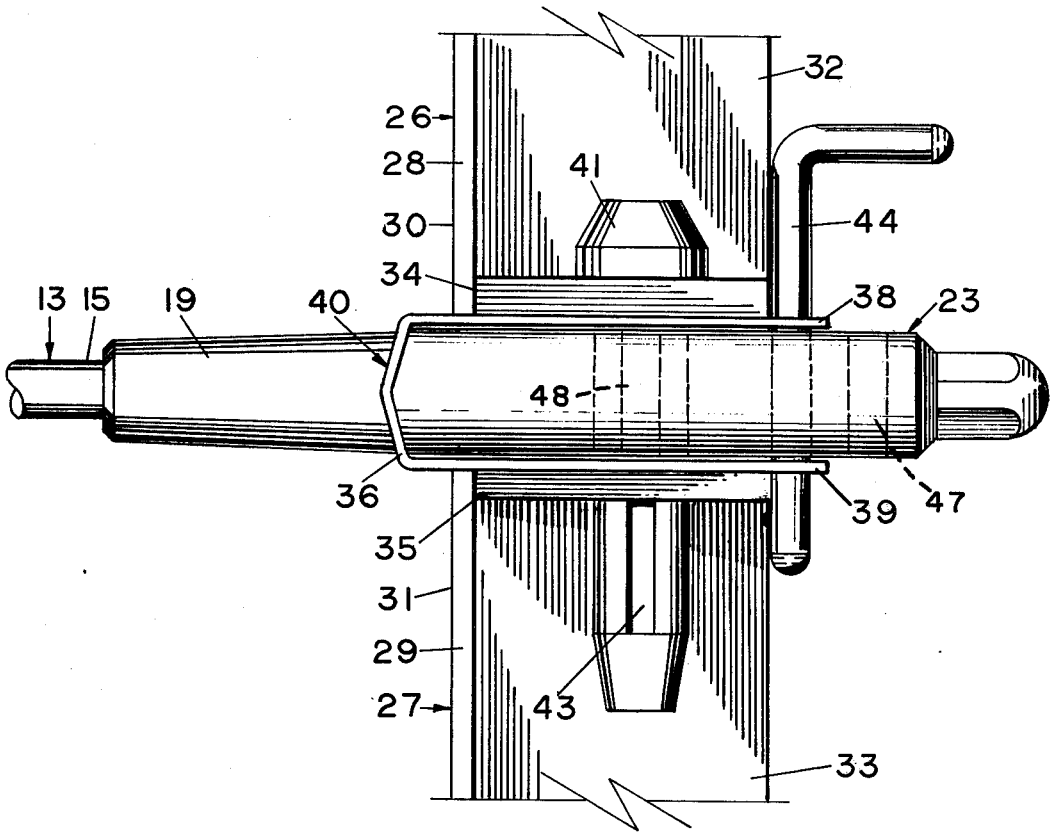
FIG. 2 is a top view on an enlarged scale showing the interrelationship between the junction assembly and the tie systems.
Figure 3:
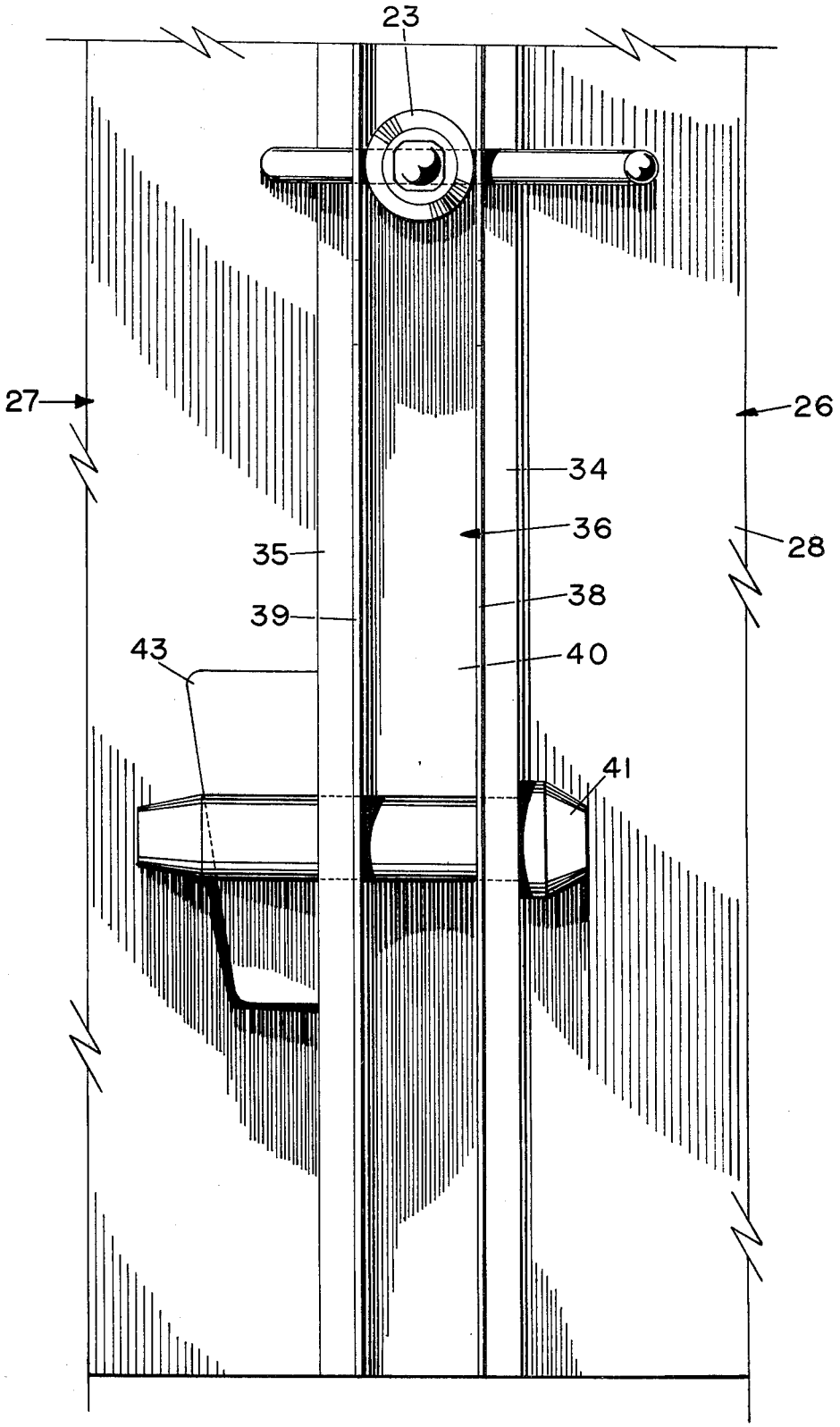
FIG. 3 is a fragmentary elevation at the panel junction, illustrating the panel-securing and the bolt-securing devices.
Figure 5:
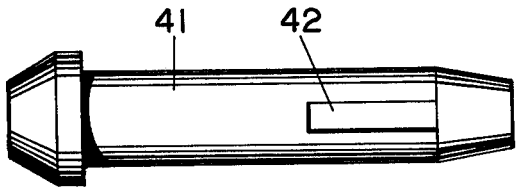
FIG. 5 is an elevation showing the wedge pin preferably used to traverse the panel flanges and the channel for securing the lateral position of the form panel elements.

Referring to FIG. 2, the adjacent form panel units 26 and 27 consist of an inner metal sheet 28–29 defining coplanar forming surfaces 30 and 31. The metal sheets 28 and 29 are stiffened by beams as shown at 32–33 preferably welded to the sheets 28 and 29, and the meeting edges of the form 26 and 27 are defined by the flanges 34 and 35, which are relatively heavy bars welded both to the sheets 28 and 29, and to the stiffening beams 32 and 33. Junction channels as shown at 36 and 37 in FIG. 1 are interposed between the edge flanges 34 and 35, with the walls 38 and 39 of the channel preferably resiliently engaging the panel flanges. The central portion 40 of channel extends between the walls 38 and 39, and is provided with apertures for receiving the bolts 23. This assembly is secured together at holes 36*a* and 37*a* corresponding to selected flange holes as shown in FIG. 3 by the spaced wedge pins or bolts of the type shown at 41, which have a transverse slot 42 (see FIG. 5) for receiving the wedges 43. These are driven downward to establish the necessary clamping pressure. These fasteners are shown in detail in FIG. 5, and are conventional.

Figure 4:
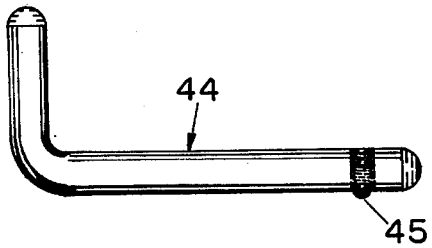
FIG. 4 is an elevation showing the cross-pin preferably used to secure the bolts of the tie system with respect to the channel walls.
Figure 6:
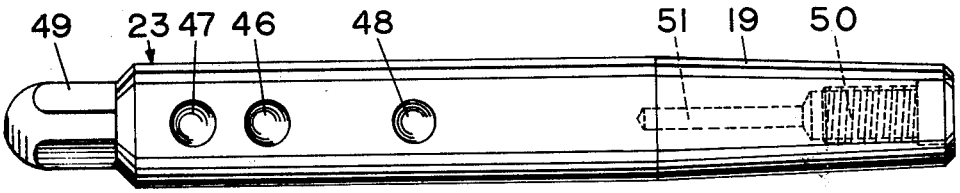
FIG. 6 is an elevation of a typical bolt used to traverse the panel system.

Referring particularly to FIG. 2, the bolts 23 are fixed with respect to the assembly by the cross-pins 44 of the angular configuration shown in FIG. 4. These pins traverse the walls 38 and 39 of the channel 40 at a position where they can also bear upon the edges of the panel flanges 34 and 35 to transfer the concrete pressure forces on the panel system to the tie assemblies. It is preferably that the pins 44 include a spring detent of conventional design, as shown at 45, to assure that the pins remain in engagement until they are forceable removed. After the bolts have been rotated out of engagement with the central rods, and the channels removed, the bolts may be re-installed and cross-pinned at either of holes 46 and 47, depending upon the desired form spacing. Alternatively, the holes shown at 48 in FIG. 6 may be used to establish a retracted position of the bolts (after they have been unscrewed from the central tie rods) so that the bolts may be cross-pinned at these holes, and thus left in assembled relationship with the junction channels. The junction channels, together with the bolts, may then be installed at a subsequent erection of the form system, and the bolts then individually shifted from the retracted position into the final position as they are threaded on to a new set of tie rods. Preferably, the bolts 23 have a squared end, as shown at 49 in FIG. 6, to receive a standard wrench. The internal threading shown at 50 in the opposite end of the bolts is conventional for receiving the tie rods, and the extra depth of the hole 51 continuing axially inward from the threaded portion is provided for accumulation of foreign particle, which may be forced in ahead of the tie rod as it is engaged with the threading 50.

I claim:

1. A form system for constructing concrete walls, said system including form panels having the forming surfaces thereof disposed in spaced parallel relationship and interconnected by tie means each including a central rod and a bolt connected to each end of said rod, said panels on each side of said system having adjacent edges defined by flanges receiving securing means holding said panels against lateral separation, wherein the improvement comprises:

an elongated connecting member having a substantially U-shaped cross-sectional configuration interposed between said panel edges with the sides of said member adjacent the said edges, said members forming a closure between adjacent panels, and said members each having at least one opening in the central portion thereto receiving one of said bolts, said bolts having a width equal to a major portion of the distance between the sides of said connecting members, respectively; and cross-pin means removeably traversing each of said bolts and said connecting member sides adjacent thereto, said securing means traversing said connecting members and said panel flanges, said connecting member sides extending beyond said panel flanges in a direction perpendicular to said forming surfaces, and said cross-pin means traverses said sides in the portion thereof extending beyond said flanges and bears against the edges of said flanges to provide the primary force transfer between said tie means and said form panels.

2. A system as defined in claim 1, wherein the said central portion of said connecting members project inwardly beyond the plane of the forming surfaces of adjacent panels.

3. A system as defined in claim 1, wherein said tie means has a plurality of holes for receiving said cross-pin means, certain of said holes being disposed spaced outwardly from said flanges, said cross-pin means having a detent device for resiliently retaining said cross-pin means in said tie means, said cross-pin means being removeable from said tie means.

* * * * *